US005455404A

United States Patent [19]

Sakai et al.

[11] Patent Number: 5,455,404

[45] Date of Patent: Oct. 3, 1995

[54] COOKING APPARATUS

[75] Inventors: Masayuki Sakai; Kenji Kume, both of Otsu, Japan

[73] Assignee: Sanyo Electric Co., Ltd., Moriguchi, Japan

[21] Appl. No.: 389,027

[22] Filed: Feb. 15, 1995

[30] Foreign Application Priority Data

Feb. 15, 1994 [JP] Japan ..... 6-018517

[51] Int. Cl.[6] ..... H05B 6/68

[52] U.S. Cl. ..... 219/708; 99/325; 99/331; 219/518

[58] Field of Search ..... 99/325, 451, 331–333, 99/DIG. 14; 219/705, 707, 708, 730, 754, 518, 492; 177/144, 244, 245, 256; 426/233, 243, 524

[56] References Cited

U.S. PATENT DOCUMENTS

| | | | |
|---|---|---|---|
| 4,517,429 | 5/1985 | Horinouchi | 99/325 |
| 4,521,658 | 6/1985 | Wyland | 219/708 |
| 4,590,350 | 5/1986 | Ueda | 99/325 |
| 4,591,684 | 5/1986 | Tanabe et al. | 99/451 |
| 4,595,827 | 6/1986 | Hirai et al. | 99/325 |
| 4,599,503 | 7/1986 | Ueda | 99/325 |
| 4,615,405 | 10/1986 | Morino et al. | 219/708 |
| 4,705,926 | 11/1987 | Sakai et al. | 99/325 |
| 4,757,181 | 7/1988 | Sakamoto et al. | 219/708 |
| 5,247,146 | 9/1993 | Civanelli et al. | 426/243 |
| 5,302,792 | 4/1994 | No et al. | 219/518 |
| 5,369,254 | 11/1994 | Kwon | 219/708 |

FOREIGN PATENT DOCUMENTS

| | | | |
|---|---|---|---|
| 4-45318 | 2/1992 | Japan . | |
| 57-187535 | 11/1992 | Japan | 219/708 |

*Primary Examiner*—Timothy F. Simone
*Attorney, Agent, or Firm*—Darby & Darby

[57] ABSTRACT

A cooking apparatus provided with a weight unit changing key for changing a weight unit and an operation detection means for detecting that the weight unit changing key has been operated plural times, wherein when the operation detection means detects that the weight unit changing key has been operated plural times, the apparatus is placed in a standby state for the weight unit changing operation, and the weight unit can be changed by the subsequent operation so that a user not familiar with the apparatus can easily change the weight unit without a failure.

13 Claims, 7 Drawing Sheets

COOKING APPARATUS

BACKGROUND OF THE INVENTION

1. Field of the Invention

The present, invention relates to a cooking apparatus that controls the heating operation according to the weight of an object to be cooked.

2. Description of Related Art

A cooking apparatus that controls the heating operation according to the weight of an object to be cooked is disclosed in Japanese Patent Application Laid-open No. 4-45318 (1992). This cooking apparatus has input means for setting the cooking parameters, weight setting means for setting the weight, weight unit storing means for storing the weight unit, cooking start instructing means for instructing to start cooking and heating means for heating the object to be cooked. Such an arrangement is made for setting the weight unit in this cooking apparatus that, in the initial state before setting by means of the input means and the weight, unit setting means, the weight unit stored in the weight unit storing means can be changed when it is instructed to start cooking by means of the cooking start instructing means.

With such an arrangement, it is not necessary to provide in operation control means a control key for changing the weight unit that, is generally rarely used after once being set. Because the heating control is usually carried out by means of a microcomputer and the number of input/output ports is limited, omitting the control key for changing the weight unit enables the limited number of the input/output, ports to be used for other functions, resulting in making the cooking apparatus user friendly.

By omitting the control key for changing the weight unit, the operation control means of the cooking apparatus having the weight unit changing function can be commonly used also in a cooking apparatus distributed to regions where it is not necessary to change the weight unit.

However, because this changing system of the weight unit is carried out not by the control key for changing the weight unit but by a control key for the cooking start, instruction, the weight unit is changed by a single key operation. Therefore, there is a possibility of changing the weight unit by mistakenly operating the control key without the intention of changing the weight unit.

Specifically, when a user connects the power plug of the cooking apparatus to a power out, let and turns on the power switch for the first time after purchasing it, it is highly probable that the user is not familiar with the operating procedure of the cooking apparatus. Usually, the user learns the operation procedure while consulting the instruction manual from then on. In such a case, the user may operate the control keys randomly without knowing the functions of the keys, or a child nearby may tamper with the control keys, resulting in the weight unit being changed in a single action although the user is not aware of the fact that the weight unit is changed because of unfamiliarity with the operating procedure. Thus the user may start cooking with the wrong weight unit being set.

When the unit of kg that has been initially set is changed to the unit of lb (pound), attempt to enter 1 kg actually results in entering 1 lb (approximately 0.45 kg) and, when cooking is carried out in a heating sequence based on this weight, the material to be cooked will not be sufficiently cooked.

On the contrary, when the unit of lb that has been initially set is changed to the unit of kg, attempt to enter 1 lb actually results in entering 1 kg. When the material is cooked in a heating sequence based on this weight, it will be overcooked and eventually burned.

SUMMARY OF THE INVENTION

The present, invention has been devised to solve the problems described above, and an object thereof is to provide a cooking apparatus that allows even a user who is unfamiliar with the cooking apparatus to change the weight unit without failure.

The cooking apparatus of the invention has a heating chamber that houses an object to be cooked, a heating unit for heating the object housed in the heating chamber, a key unit provided with numerical keys for the input of the weight of the object and with a weight unit changing key for changing the weight unit, weight unit storage means for storing the weight unit that has been set, heating control means that controls the heating unit according to the weight entered by means of the numerical keys and the weight unit stored in the weight unit storage means, operation detection means that detects whether or not the weight unit changing key has been operated plural times, and weight unit changing means that changes the weight unit stored in the weight unit storage means when the operation detection means detects that the weight unit changing key has been operated plural times.

Therefore, in the case where the user mistakenly changes the weight unit without the intention, the weight unit is not changed because the weight unit changing key is not operated plural times. The weight unit is changed only when the user carries out a particular key operation for changing the weight unit.

In the cooking apparatus of the invention, the key unit has a start key to drive the heating unit and an automatic cooking setting key for reading a heating sequence that has been set, wherein one of the keys provided in the key unit is used as the weight unit changing key as well as for another function.

This arrangement makes it possible to omit an exclusive key for changing the weight unit and to provide another function key instead, improving the user friendliness of the apparatus.

In the cooking apparatus of the invention, the key unit has a start key to start a cooking operation and an automatic cooking setting key for reading a heating sequence that has been set, wherein a plurality of the keys provided in the key unit are used as the weight unit changing key as well as for other functions, and the operation detecting unit detects whether or not the plurality of the keys are operated at the same time.

Therefore, the user is made to recognize that the input operation is different from the ordinary operation by requiring to operate a plurality of keys at the same time, preventing the user from being unconfident about the changing operation.

In the cooking apparatus of the invention, the key unit has a start key to start a cooking operation and an automatic cooking setting key for reading a heating sequence that has been set, wherein a plurality of the keys provided in the key unit are used as the weight unit changing key as well as for other functions, and the operation detecting unit detects whether or not the plurality of the keys are operated sequentially.

Therefore, the user is made to recognize that the weight unit changing operation is being done by requiring to operate the plurality of the keys sequentially, preventing the user from being unconfident about the changing operation.

In the cooking apparatus of the invention, after it is detected that the weight unit changing key has been operated plural times, the weight unit changing means changes the weight unit stored in the weight unit storage means every time the weight unit changing key is operated.

Therefore, because the weight unit is changed every time the weight unit changing key is operated, the apparatus becomes more user friendly when the user wants to change the weight unit again after once changing the weight unit.

In the cooking apparatus of the invention, a timer is additionally provided and the weight unit changing means is inhibited from changing the weight unit after the timer has counted a predetermined time.

Therefore, because the standby state for changing the weight unit is canceled after the predetermined period of time, the weight unit cannot be easily changed by mistakenly operating the keys that are under operation.

The above and further objects and features of the invention will more fully be apparent from the following detailed description with accompanying drawings.

DESCRIPTION OF THE PREFERRED EMBODIMENTS

The invention will now be described in detail below with reference to the accompanying drawings showing the preferred embodiments thereof.

Figure 1:
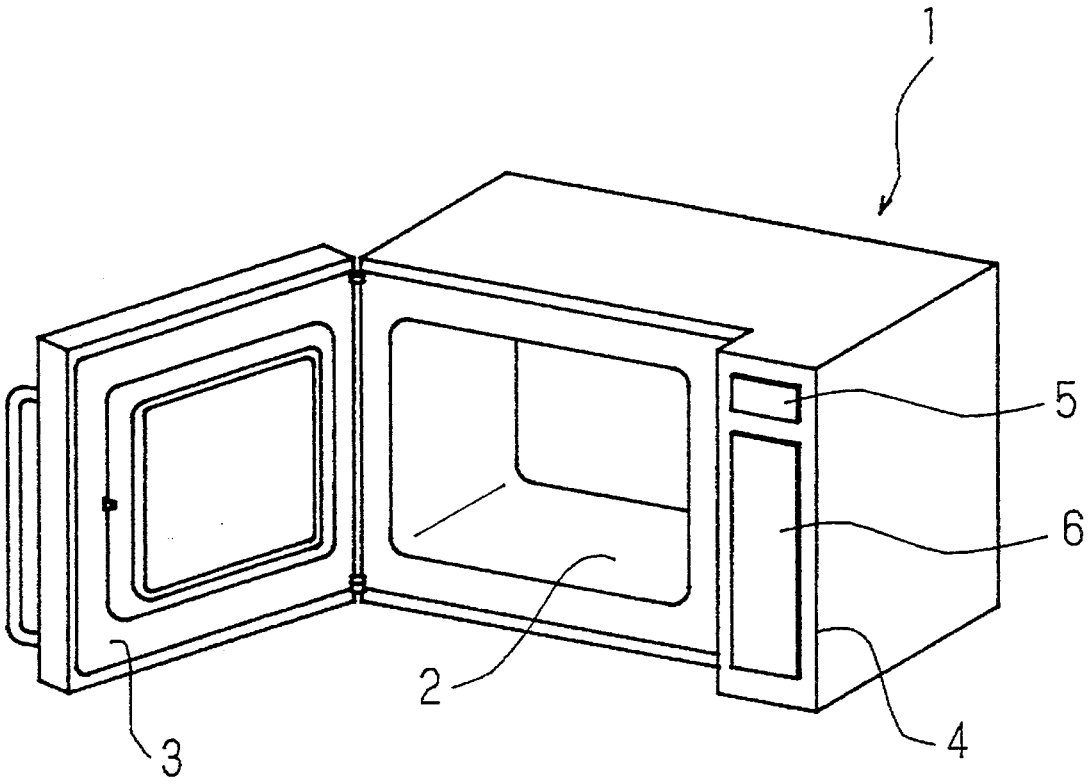
FIG. 1 is an overview of a cooking apparatus, that is, a microwave oven of the invention.

FIG. 1 shows the overview of a microwave oven of the invention. In the drawing, numeral 1 denotes the body of the microwave oven, and an object to be cooked is charged in a heating chamber 2, a door 3 for opening and closing a front opening of the heating chamber 2 is closed and a key operation is carried out on a control panel 4 provided on the front face of the microwave oven body 1 to set cooking parameters, thereby to heat and cook the object.

Figure 2:
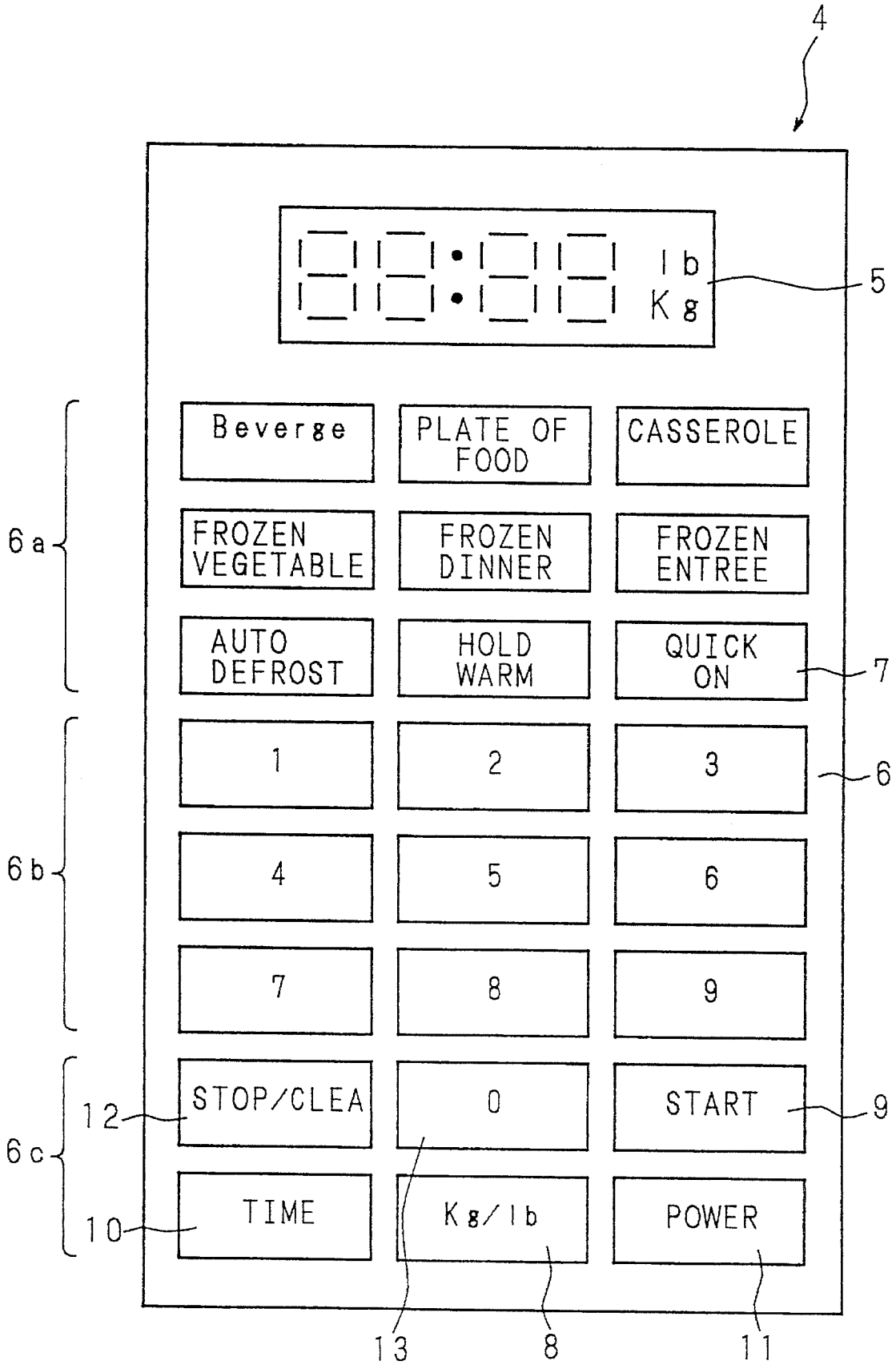
FIG. 2 is an enlarged view of a control panel shown in FIG. 1.

FIG. 2 shows an enlarged view of the control panel 4 shown in FIG. 1. Provided in the upper portion of the control panel 4 is a display unit 5 that displays settings of the cooking parameters such as a heating time, a set weight and a weight unit so that the cooking parameters can be set while confirming the values displayed in the display unit 5. Provided below the display unit 5 is a key unit 6. The key unit 6 has quick setting keys *6a* for setting the type of cooking, numerical keys *6b* for setting the weight of the object to be cooked and the heating time, and operation setting keys *6c* for determining the operation to be set.

For example, the quick setting keys *6a* include function keys such as a "QUICK ON" key 7, a "CASSEROLE" key to be pressed after pressing the "QUICK ON" key 7 for a boiling operation and an "AUTO DEFROST" key for defrosting. The numerical keys *6b* include a "0" key 13 and keys having single-digit numerical letters "1" through "9" inscribed thereon, in which the "0" key 13 also serves as a weight unit changing key to be described later. The operation setting keys *6c* include a weight setting key 8 for setting the weight, a "START" key 9 for starting the cooking operation, a "TIME" key 10 for set, ting the heating time, a "POWER" key 11 for setting the heating power and a "STOP/CLEA" key 12 for stopping the cooking operation or clearing the settings.

Figure 3:
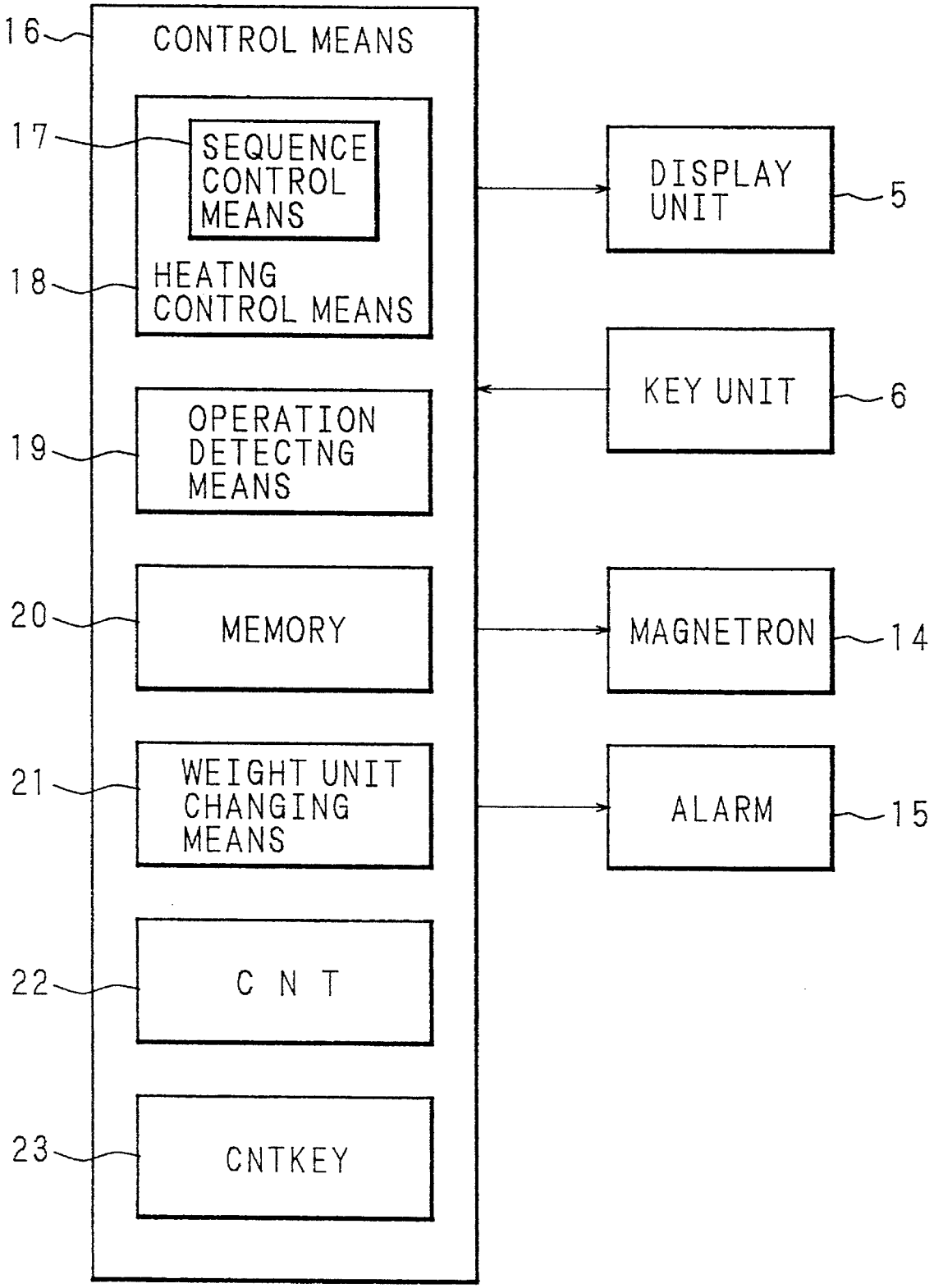
FIG. 3 is a functional block diagram for the weight unit changing operation in the microwave oven shown in FIG. 1.

FIG. 3 is a functional block diagram for the weight unit changing operation in the microwave oven of the invention shown in FIG. 1. A control means 16 provided in a microcomputer outputs signals for the display on the display unit 5 according to signals entered through the key unit 6, outputs a signal for making an alarm sound to notify the user and outputs a signal for making a magnetron 14 carry out the heating and cooking operation. The control means 16 has sequence control means 17 for setting the heating sequence according to the weight of the object to be cooked entered through the key unit 6, heating control means 18 that controls the magnetron 14 according to the heating sequence, operation detecting means 19 that checks whether or not the weight unit, changing key ("0" key 13) has been operated plural times, a memory 20, weight unit changing means 21 for changing the weight unit when the operation detection means 19 detects plural key operations, a 3-minute counter (CNT) 22 that counts a period of time (3 minutes) during which the weight unit can be changed, and an operation number counter (CNTKEY) 23 that counts the number of operations of the "0" key 13.

The memory 20 has a reset flag (REST), a pound flag (LB), a kilogram flag (KG) and a cooking storage unit. The reset flag (REST) is set to be 1 during the period that allows to change the weight unit, namely during the counting operation of the CNT 22, and is reset to be 0 when the counting operation of the CNT 22 completes. The pound flag (LB) is set to be 1 when the weight unit is set to be the unit of pound. The kilogram flag (KG) is set to be 1 when the weight unit is set to be the unit of kilogram. The cooking storage unit stores standard heating sequences such as defrosting that are set with the quick setting keys *6a*. The LB and the KG constitute weight unit storage means.

Figure 4:
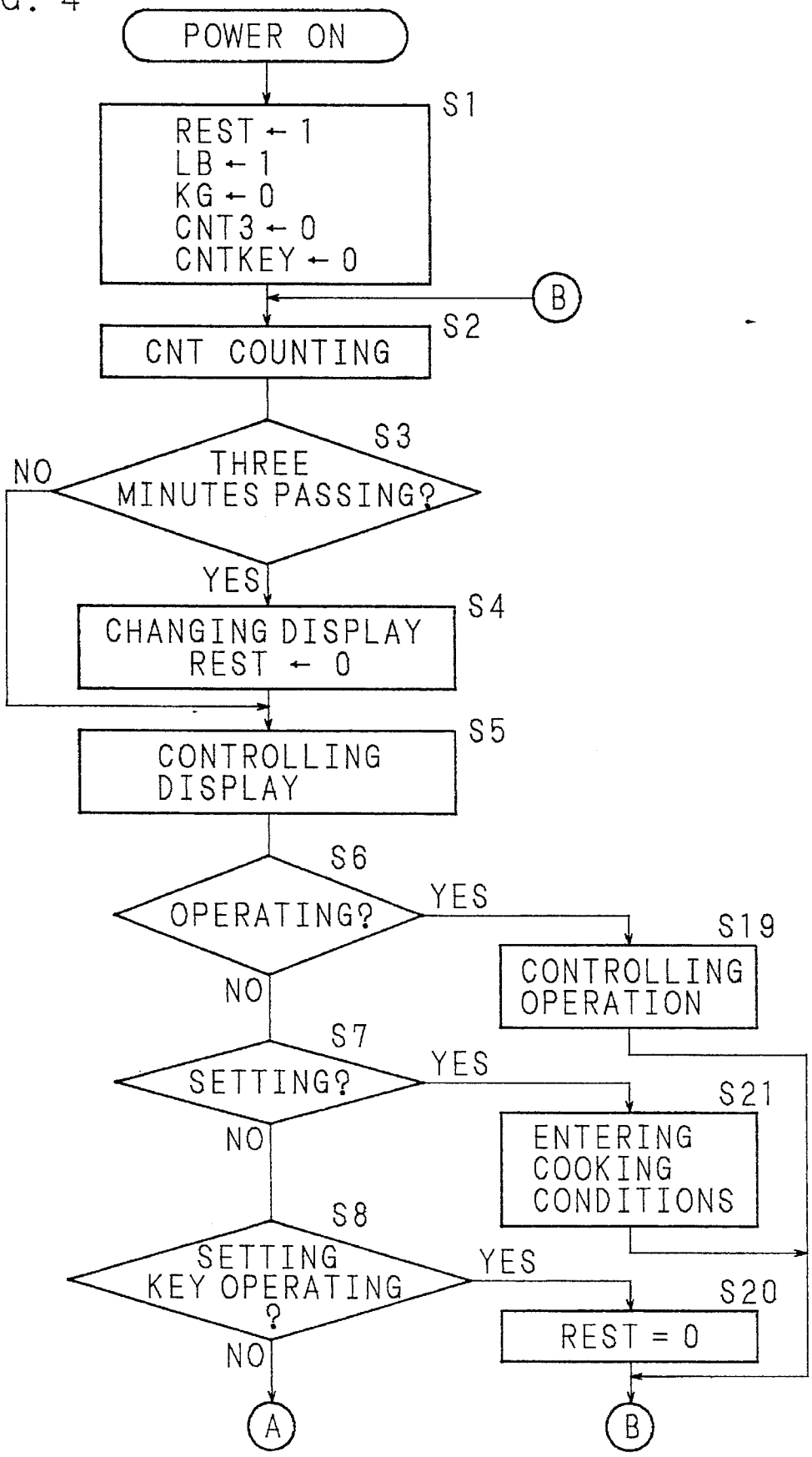
FIG. 4 is a flow chart explaining the operation of changing the weight unit in this embodiment.
Figure 5:
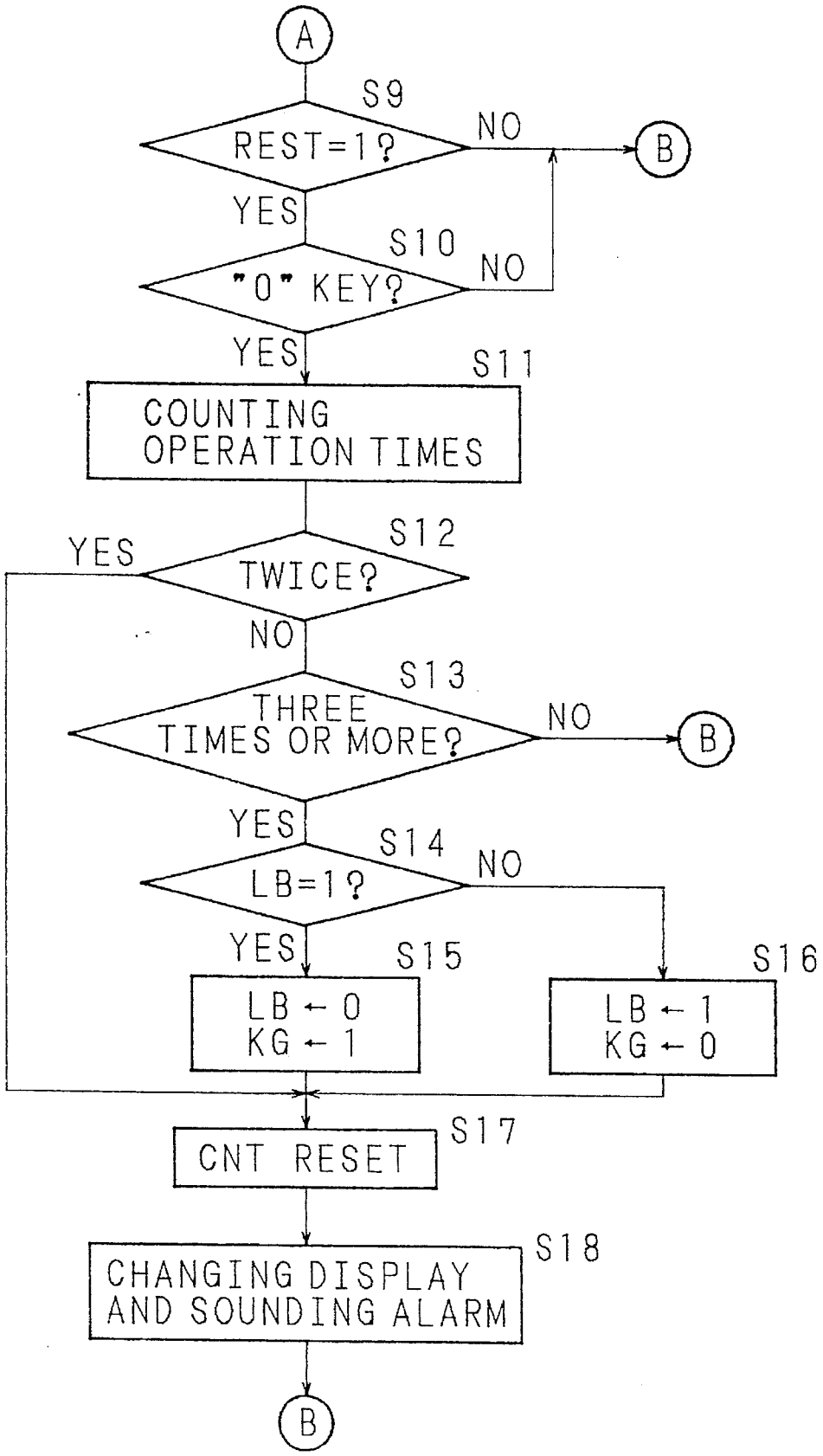
FIG. 5 is a flow chart explaining the operation of changing the weight unit in the microwave oven.

FIG. 4 and FIG. 5 are flow charts explaining the operation of the control means 16 for changing the weight unit when using the microwave oven having the configuration as described above. When a power plug of the microwave oven body 1 is connected to a power outlet and the power switch is turned on, the initial state is set (step S1). The initial state refers to such a condition that the REST is set to be 1 and the CNT 22 and the CNTKEY 23 are set to be 0, and the LB is set to be 1 and the KG is set to be 0 because the weight unit is set to be the unit of pound before shipment from the factory. Then the CNT 22 starts counting (step S2), it is determined whether or not 3 minutes have passed (step S3) and, in the case where 3 minutes have passed, the REST is reset to be 0 (step S4) and, in the case where 3 minutes have not passed, the display unit 5 shows the current time (step S5).

Then it is checked whether or not a heating operation is being carried out, namely whether or not the "START" key 9 has been pressed (step S6). In the case where the heating operation is being carried out, operation control is carried out (step S19), and the procedure proceeds to step S2. In the case where the heating operation is not being done, it is checked whether or not a weight, a heating time or a heating power is set by operating the weight setting key 8, the "TIME" key 10, the "POWER" key 11 or the like (step S7). In the case where the weight, the heating time or the heating power is set, the cooking parameters that have been entered are set (step S21) and the procedure proceeds to step S2. In step S21, the sequence control means 17 changes the heating sequence from the standard sequence to that determined by set weight and the set values in the LB and the KG.

The same effect can also be obtained as follows: the weight of the object to be cooked is set by pressing the "1" key among the numerical keys **6*b* then pressing the weight setting key 8, and the setting operation is completed by pressing the weight setting key 8** again. This can be applied to the setting and the setting completion of the heating time and the heating power.

In the case where the weight, the heating time or the heating power is not set, it is checked whether or not the quick setting key **6*a* or the "START" key 9 has been pressed (step S8). In the case where the quick setting key 6*a* or the "START" key 9 has been pressed, the REST is set to be 0 (step S20), and the procedure proceeds to step S2. In the case where the quick setting key 6*a* or the "START" key 9 has not been pressed, it is checked whether or not the REST is set to be 1 (step S9). In the case where the REST is not set to be 1, the procedure proceeds to step S2. In the case where the REST is set to be 1, it is checked whether the "0" key 13 is pressed or not (step S10) and, in the case where it is not pressed, the procedure proceeds to step S2. After proceeding to step S2, a standby loop from step S2 to step S10** is executed.

In the case where the "0" key 13 is operated in step S10, the CNTKEY 23 counts the number of times the "0" key 13 is operated (step S11). When the operation detection means 19 finds that the "0" key 13 has been operated twice (step S12), the CNT 22 is reset (step S17). When the number of operations is not 2, it is checked whether the key has been operated three times or more (step S13). When the operation detection means 19 judges that the key has not be operated three times or more, the procedure proceeds to step S2. When the operation detection means 19 judges that the "0" key has been operated three times or more, it is checked whether the LB is set to be 1 or not (step S14). When the LB is set to be 1, the weight unit changing means 21 changes the LB to be 0 and KG to be 1 (step S15). When the LB is not set to be 1, the weight unit changing means 21 changes the LB to 1 and KG to 0 (step S16). Upon completion of this changing operation, the CNT 22 is reset and started to count from 0 (step S17), and the display of the current time on the display unit 5 is changed to display the weight unit currently set, or the display the weight unit currently set is changed to the weight unit to be selected, and the alarm sound is made to notify that the apparatus is in the weight unit changing mode (step S18), then the procedure proceeds to step S2.

To change the weight unit from pound to kilogram, for example, the user is required to press the "0" key 13 in the key unit 6 plural times continuously before the CNT 22 completes the counting operation and the reset flag is reset to be 0. First, the user presses the "0" key 13 once to follow the loop from step S13 to step S2. Then the user presses the "0" key 13 for the second time, so that lb is displayed on the display unit 5 and make the alarm sound (step S18), and then the procedure returns to step S2. When the user presses the "0" key 13 for the third time, the weight unit changing means 21 changes the LB to 0 and KG to 1 (step S15), and the display unit 5 displays kg and the alarm sound is made (step S18). By pressing the "0" key 13 continuously as described above, the operation to change the weight unit is carried out.

In this sequence of operations, the reason for making the sound of the alarm 15 by the second operation of the "0" key 13, not by the first operation thereof, is to ensure that the user has the intention of changing the weight unit and inform the user that the apparatus is in the weight unit changing mode. This is also for the purpose of reassuring the user by informing that a single operation of the "0" key 13 by mistake does not have any effect, because most of the erroneous operations of the "0" key 13 are carried out by a single operation of the key. An alarm in the first operation of the key may cause the user to be bewildered and the user may think that some trouble may have been caused by the misoperation.

The reason for merely notifying that the apparatus has entered the weight unit changing mode without changing the weight unit in the second operation of the "0" key 13 is as follows: there is a possibility that the user may be unaware of when the weight unit is changed if the weight unit is changed in the second operation. And it is easier for the user to recognize that the weight unit is changed when the unit is changed in the next operation after confirming that the apparatus is in the weight unit changing mode.

Thereafter, the weight unit can be changed every time the "0" key 13 is pressed till the REST becomes 0 during the counting operation of the CNT 22, while the weight unit changing means 21 sets and resets the LB and the KG in the memory 20, by executing step S15 or step S16.

When changing of the weight unit is completed, it is detected in step S3 that the counting operation of the CNT 22 has been completed, and accordingly the REST is reset to be 0 in step S4, the display of the display unit 5 is changed to the current time thereby to end the weight unit changing mode.

Then, the user puts an object to be defrosted in the heating chamber 2, closes the door 3, operates the "QUICK" key 7 and operates the "AUTO DEFROST" key to carry out automatic defrosting of the object. At this point, the procedure proceeds from step S8 to step S20 to reset the REST to be 0, and the sequence control means 17 reads the standard heating sequence for defrosting from the memory 20 and the procedure returns to the standby loop.

The operation in step S20 is to determine, when the quick setting key **6*a* or the "START" key 9 is operated during the operation of the CNT 22**, that the user does not have the intention to change the weight unit and to automatically end the weight unit changing mode.

When the user operates the "START" key, this is detected in step S6 and the heating control means 18 controls the magnetron 14 according to the heating sequence in step S19, thereby to start the heating control. At this point, the heat-cooking operation is executed in step S2, step S5, step S6 and step S19.

Upon completion of the heating operation according to the heating sequence, the sound of the alarm 15 is made to inform the user of the completion of cooking and the heat-cooking operation is completed. Thereafter, the standby loop from step S2 to step S9 is executed and the apparatus is placed in the standby state for the next heating operation.

In the case where cooking operation is to be carried out without changing the weight unit, the cooking conditions are set in step S7 regardless of the counting operation of the CNT 22. Then, the heating operation is started without the weight unit changing mode.

Figure 6:
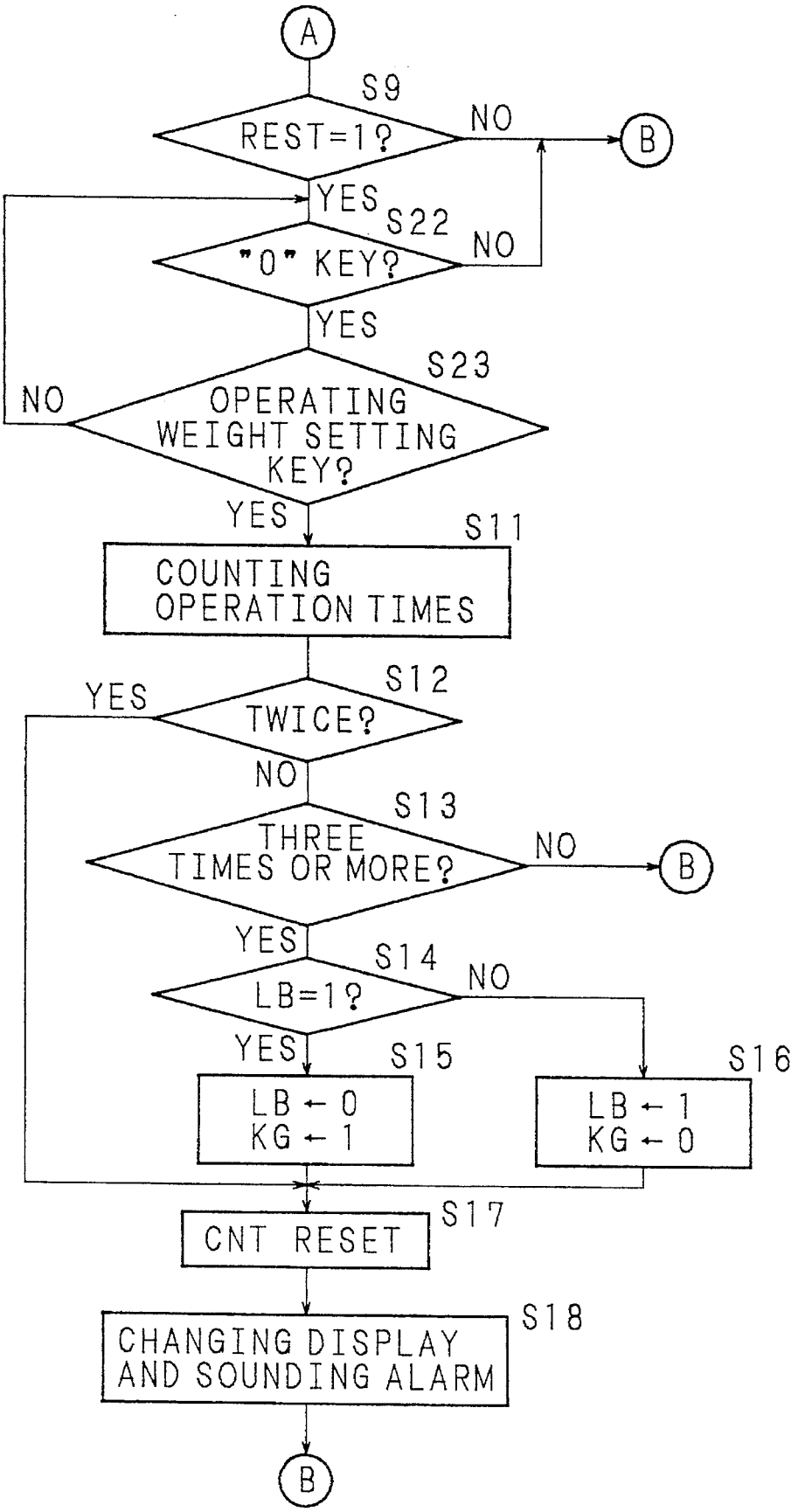
FIG. 6 is a subsequent flow chart explaining the operation of changing the weight unit in another embodiment of the invention.

Although the "0" key 13 is used as the weight unit changing key for changing the weight unit in the above description, such an arrangement that a plurality of the control keys are operated plural times at the same time may be employed as another embodiment. FIG. 6 is a flow chart explaining the operation of changing the weight, unit in this case. A and B in this flowchart correspond to those shown in FIG. 4.

It is determined that the REST is 1 in step S9, and it is checked whether the "0" key 13 is operated or not (step S22) and whether the weight setting key 8 is operated or not (step S23). When both keys are operated, the number of operations thereof are counted (step S11). With respect to the other steps, the steps identical to those shown in FIG. 5 are carried out similarly and therefore the description thereof will be omitted. The weight unit changing key is not limited to the "0" key 13 and the weight setting key 8, and any keys in the key unit 6 may be used for this purpose. Also they may be operated sequentially instead of operating simultaneously.

Figure 7:
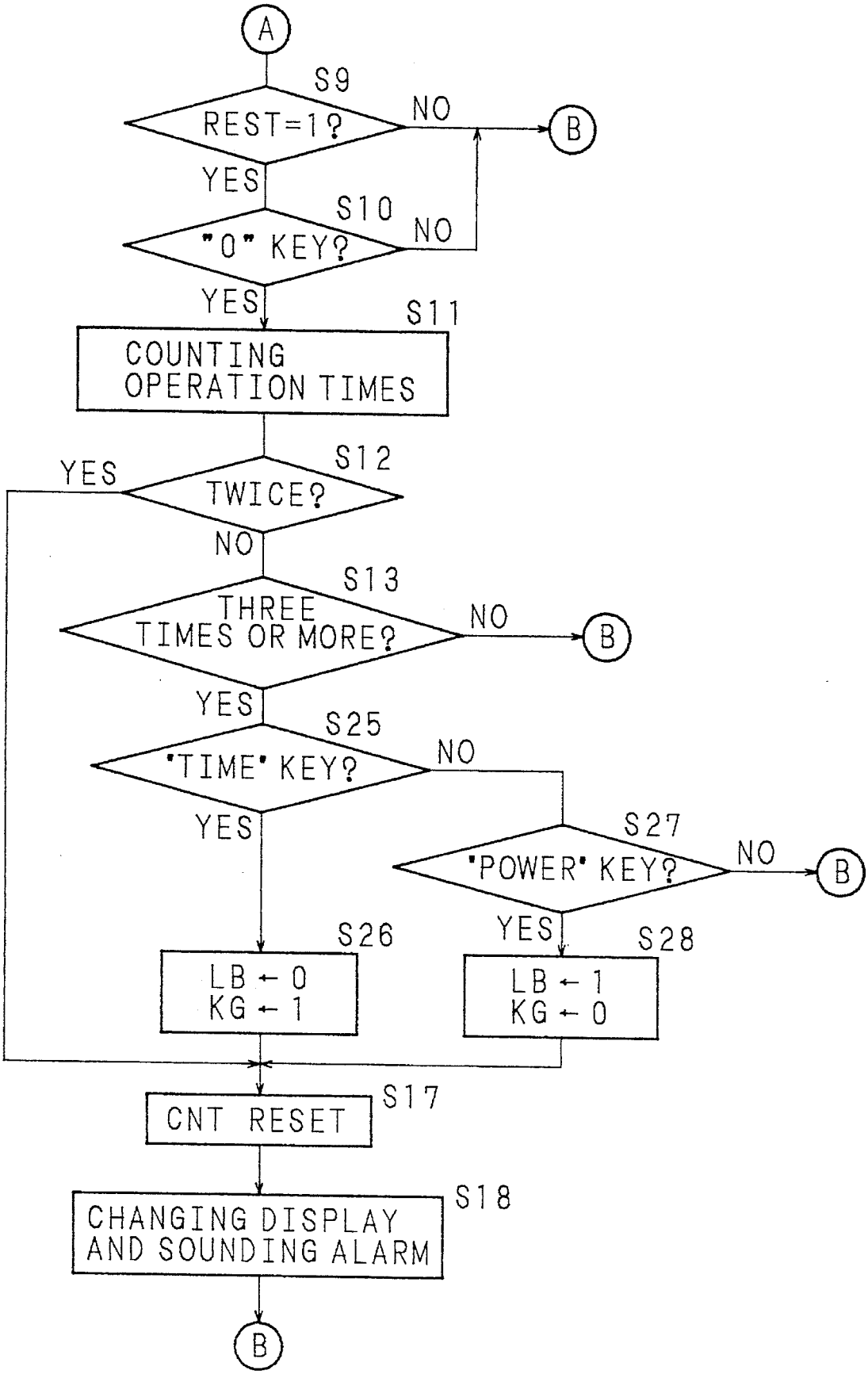
FIG. 7 is a flow chart explaining the operation of changing the weight unit in another embodiment of the invention.

Although the weight unit is switched between pound and kilogram by operating the "0" key 13 plural times, different key operations may be employed when changing from pound to kilogram and when changing from kilogram to pound as another embodiment. FIG. 7 shows a flow chart explaining the operation of changing the weight unit in this case. A and B in this flowchart correspond to those shown in FIG. 4.

It is determined whether the "0" key 13 is operated or not in step S10 and, when it is operated three times or more (step S13), it is checked whether the "TIME" key 10 is operated or not (step S25) so that, when the "TIME" key is operated, the LB is set, to be 0 and the KG is set to be 1 (step S26). In the case where the "TIME" key 10 is not operated, it is checked whether the "POWER" key 11 is operated or not (step S27) and, when it is operated, the LB is set to be 1 and KG is set to be 0 (step S28). In the case where the "POWER" key 11 is not, operated in step S27, the procedure proceeds to step S2 and the standby loop is executed. With respect to the other steps, the steps identical to those shown in FIG. 5 are carried out similarly and therefore the description thereof will be omitted.

In the microwave oven with the configuration as described above, the user can surely and easily change the weight unit by a plurality of operations of the weight unit changing key. Although the effect described above can be obtained by providing an exclusive weight unit changing key, by using one key commonly for both the weight unit changing function and another function, the number of the ports in the microcomputer will not be affected.

Further according to the invention, it is not necessary to manufacture different types of products distributed to countries where pound is used as the weight unit (for example, Britain), countries where kilogram is used as the weight unit (for example, Japan) and countries where pound and kilogram are used in mix (for example, Canada), and the same type of product, may be distributed to all the countries. Thus it is possible to manufacture the microwave ovens in mass production and reduce the production cost.

Moreover, because alarm notification is given when the apparatus enters a state that allows to change the weight unit in this invention, the user need not count the number of the key operations, and a problem that the weight unit is changed without knowing can be avoided.

Although a case of using a magnetron as the heater is described in the above embodiment, the invention is not limited to this configuration and other heaters such as a halogen lamp heater, a quartz tube heater and a panel heater may be used.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A cooking apparatus capable of cooking an object to be cooked based on a weight of said object, a weight unit and a heating sequence for said object which have been set in said cooking apparatus, comprising:

a heating chamber which houses said object;

a heating unit for heating said object housed in said heating chamber;

a key unit having numerical keys for entering the weight of said object and a weight unit changing key for changing the weight unit;

weight unit storage means for storing the weight unit that has been set;

heating control means for controlling said heating unit according to the weight entered with said numerical keys and the weight unit stored in said weight unit storage means;

operation detection means for detecting whether or not said weight unit changing key has been operated plural times; and a weight unit changing means for changing the weight unit stored in said weight unit storage means when said operation detection means detects that said weight unit changing key has been operated plural times.

2. A cooking apparatus according to claim 1, wherein said key unit includes a start key for driving said heating unit and an automatic cooking setting key for reading the heating sequence that has been set, and one of the keys provided in said key unit is used as said weight unit changing key as well as for another function.

3. A cooking apparatus according to claim 1, wherein said key unit includes a start key for starting a cooking operation and an automatic cooking setting key for reading the heating sequence that has been set, a plurality of the keys provided in said key unit are used as said weight unit changing key as well as for other functions, and said operation detection means detects whether or not said plurality of the keys are operated at the same time.

4. A cooking apparatus according to claim 1, wherein said key unit includes a start key for starting a cooking operation and an automatic cooking setting key for reading the heating sequence that has been set, a plurality of the keys provided in said key unit are used as said weight unit changing key as well as for other functions, and said operation detection means detects whether or not said plurality of the keys are operated sequentially.

5. A cooking apparatus according to claim 1, wherein said weight unit changing means changes the weight unit stored in said weight unit storage means every time said weight unit changing key is operated after said operation detection means detects that said weight unit changing key has been operated plural times.

6. A cooking apparatus according to claim 2, wherein said weight unit changing means changes the weight unit stored in said weight unit storage means every time said weight unit changing key is operated after said operation detection means detects that said weight unit changing key has been operated plural times.

7. A cooking apparatus according to claim 3, wherein said weight unit changing means changes the weight unit stored in said weight unit storage means every time said weight unit changing key is operated after said operation detection means detects that said weight unit changing key has been operated plural times.

8. A cooking apparatus according to claim 4, wherein said weight unit changing means changes the weight unit stored in said weight unit storage means every time said weight unit changing key is operated after said operation detection means detects that said weight unit changing key has been operated plural times.

9. A cooking apparatus according to claim 1, further comprising:

a timer, wherein said weight unit changing means is inhibited from changing the weight unit after said timer has counted a predetermined time.

10. A cooking apparatus according to claim 2, further comprising:

a timer, wherein said weight unit changing means is inhibited from changing the weight unit after said timer has counted a predetermined time.

11. A cooking apparatus according to claim 3, further comprising:

a timer, wherein the weight unit changing means is inhibited from changing the weight unit after said timer has counted a predetermined time.

12. A cooking apparatus according to claim 4, further comprising:

a timer, wherein said weight unit changing means is inhibited from changing the weight unit after said timer has counted a predetermined time.

13. A cooking apparatus according to claim 5, further comprising:

a timer, wherein said weight unit changing means is inhibited from changing the weight unit after said timer has counted a predetermined time.

* * * * *